US007936893B2

(12) United States Patent
Tada et al.

(10) Patent No.: US 7,936,893 B2
(45) Date of Patent: May 3, 2011

(54) HEARING AID

(75) Inventors: Minoru Tada, Kanagawa (JP); Yosimasa Simogochi, Kanagawa (JP); Kazumasa Okamura, Ehime (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/796,175

(22) Filed: Jun. 8, 2010

(65) Prior Publication Data

US 2010/0316239 A1 Dec. 16, 2010

(30) Foreign Application Priority Data

Jun. 12, 2009 (JP) ..... 2009-140787

(51) Int. Cl.
*B25B 7/04* (2006.01)
*B25B 7/14* (2006.01)

(52) U.S. Cl. ..... 381/341; 381/322; 381/323; 381/330

(58) Field of Classification Search ..... 381/312, 381/314, 322, 323, 324, 330
See application file for complete search history.

(56) References Cited

U.S. PATENT DOCUMENTS

| | | | | |
|---|---|---|---|---|
| 4,041,251 | A | 8/1977 | Kaanders | |
| 5,799,095 | A | 8/1998 | Hanright | |
| 6,088,465 | A | 7/2000 | Hanright et al. | |
| 6,985,598 | B1 * | 1/2006 | Joschika | 381/323 |
| 7,068,804 | B2 * | 6/2006 | Batting | 381/323 |
| 7,450,732 | B2 * | 11/2008 | Kragelund | 381/323 |
| 2003/0169894 | A1 * | 9/2003 | Lin | 381/323 |
| 2005/0123157 | A1 * | 6/2005 | Kragelund et al. | 381/323 |
| 2009/0238390 | A1 | 9/2009 | Imai et al. | |

FOREIGN PATENT DOCUMENTS

| | | |
|---|---|---|
| JP | U-50-028707 | 3/1975 |
| JP | U-S58-038943 | 3/1983 |
| JP | U-S61-001999 | 1/1986 |
| JP | H7-162997 | 6/1995 |
| JP | 2001-238296 | 8/2001 |
| JP | 2006-507707 | 3/2006 |
| JP | 2008-048067 | 2/2008 |

* cited by examiner

*Primary Examiner* — Curtis Kuntz
*Assistant Examiner* — Jesse A Elbin
(74) *Attorney, Agent, or Firm* — Panasonic Patent Center; Dhiren Odedra; Kerry Culpepper

(57) ABSTRACT

In a hearing aid, a main body case has a fitting-use first communication terminal provided inside the main body case, so that the first communication terminal can be visually checked when the battery case is removed by turning, and the battery case has a first locking protrusion that is engaged with the main body case and a pressing protrusion that is opposite the first communication terminal, when the battery case is turned for installation.

4 Claims, 7 Drawing Sheets

HEARING AID

This application claims priority under 35 U.S.C. §119 to Japanese Patent Application No. 2009-140787 filed on Jun. 12, 2009. The entire disclosure of Japanese Patent Application No. 2009-140787 is hereby incorporated herein by reference.

BACKGROUND OF THE INVENTION

1. Field of the Invention

The present invention relates to an ear hook type of hearing aid.

2. Description of the Related Art

A conventional ear hook type of hearing aid comprised an ear hook that was bent so as to fit the ear, an earphone linked to the front end side of this ear hook, and a main body case linked to the rear end side of the ear hook. The main body case is formed in a shape that curves downward in a parabolic shape from a front end portion toward a rear end portion of its own.

A front microphone and a rear microphone were provided inside this main body case. The front microphone was acoustically connected via a front sound conducting path to a front sound hole provided to the front end portion of the outer wall face of this main body case. The rear microphone was acoustically connected via a rear sound conducting path to a rear sound hole provided to a portion of the outer wall face of this main body case that was farther to the rear than the front sound hole.

A battery case that is removable by turning is installed inside the rear end portion of the main body case. On this battery case were formed a first locking protrusion that engaged with the main body case when the battery case was installed inside the main body case, and a pressing protrusion that was opposite a fitting-use first communication terminal provided inside the main body case when the battery ease was installed inside the main body case (see, for example, U.S. Pat. No. 6,088,465).

When this hearing aid is used, first the ear hook is hooked over the top of the ear, and then the earphone is placed against or inserted into the ear canal in this state. Because the main body case is formed in a shape that curves downward in a parabolic shape from a front end portion toward a rear end portion, it was disposed along the rear side of the ear when the hearing aid is used.

SUMMARY OF THE INVENTION

According to the conventional example given above, the battery case is removed from the main body case by turning when the hearing aid is fitted. Then, in this state, a fitting-use second communication terminal is inserted from outside the main body case toward the first communication terminal provided inside the main body case. After this, the battery case is installed inside the main body case by turning.

As a result, the pressing protrusion provided to the battery case presses the second communication terminal against the first communication terminal. In this way, the first and second communication terminals are electrically connected, and preparation for the fitting work is completed.

The fitting work here refers to using a hearing aid adjustment device, connected to the second communication terminal, to adjust the hearing aid effect for each user.

With a conventional configuration, however, the first communication terminal disposed inside the main body case can not be seen even when the battery case is removed from the main body case by turning in order to perform the above-mentioned fitting work. Therefore, it is impossible to make sure that the second communication terminal is properly disposed. Accordingly, if the second communication terminal is not properly disposed, when the battery case is turned for installation, the pressing protrusion provided to the battery case is not press the second communication terminal properly against the first communication terminal. As a result, there are times when electrical connection between the first and second communication terminals can not be carried out properly, in which case the fitting work can not be carried out smoothly. Improper disposition of the second communication terminal with respect to the first communication terminal is particularly prone to occurring when a thinner second communication terminal is used for the purpose of making the main body case smaller.

In view of this, it is an object of the present invention to be able to carry out fitting work smoothly.

The hearing aid pertaining to the present invention comprises an ear hook bent for attachment to an ear, an earphone linked to the front end side of the ear hook, a main body case linked to the rear end side of the ear hook, and a battery case attached to the main body case. The main body case is formed in a shape that curves downward in a parabolic shape from the front end portion toward the rear end portion. The battery case is installed inside the rear end portion of the main body case, and is removable by turning. The main body case has a fitting-use first communication terminal provided on the radial outside in the main body case. The first communication terminal is electrically connected to a fitting-use second communication terminal inserted from outside the main body case. The first communication terminal and the second communication terminal can be visually checked from outside the main body case when the battery case is removed by turning. The battery case has a first locking protrusion that is engaged with the main body case when the battery case is turned for installation, and a pressing protrusion that is opposite the first communication terminal when the battery case is turned for installation. The turning axis of the battery case is provided on the radial inside in the main body case, and is located above the first locking protrusion of the battery case when the battery case is turned for installation.

With the hearing aid pertaining to the present invention, when the battery case is removed to perform fitting by turning, the fitting-use first communication terminal can be visually checked. Therefore, a visual check can be made of the joint state of the first communication terminal and the fitting-use second communication terminal inserted from outside the main body case. Accordingly, when the battery case is turned for installation inside the main body case, the pressing protrusion provided to the battery case accurately press the second communication terminal against the first communication terminal. Consequently, electrically connected between the first and second communication terminals is carried out properly, so fitting work can be carried out smoothly.

DETAILED DESCRIPTION OF THE INVENTION

The hearing aid in an embodiment of the present invention will now be described through reference to the drawings. In the following description of the drawings, components that are the same or similar will be numbered the same or similarly. The drawings, however, are just schematic representations, and the dimensional ratios and so forth may differ from those of an actual product. Therefore, specific dimensions and so forth should be determined by referring to the description that follows. Dimensional relationships and ratios may, of course, also vary between the drawings.

Also, in the following description, it should be noted that the terms "upper," "lower," "front," "rear," "left," "right," and "horizontal" are from the reference point of the user wearing the hearing aid.

Embodiments

FIGS. 1A and 1B and FIGS. 2A to 2D show a hearing aid pertaining to an embodiment of the present invention, which is to be worn on the right ear. The hearing aid in this embodiment, as shown in FIGS. 1A and 1B and FIGS. 2A to 2D, comprises an ear hook 1 that is bent in an approximate arc shape for hooking onto the ear, an earphone 2 that is linked to the front end side of the ear hook 1 (more specifically, the lower end of the portion extending downward from the front end of the ear hook 1), and a main body case 3 that is linked to the rear end side of the ear hook 1.

The main body case 3, as shown in FIGS. 1A and 1B and FIGS. 2A to 2D, is formed in a shape that curves downward in a parabolic shape from the front end side toward the rear end side. The main body case 3 is provided along the rear of the ear when worn by the user. That is, when this hearing aid is used, first the ear hook 1 is hooked over the top of the ear, and in this state the earphone 2 is placed against or inserted into the ear canal (not shown), so that the main body case 3 is provided along the rear of the ear as mentioned above.

Figure 3:
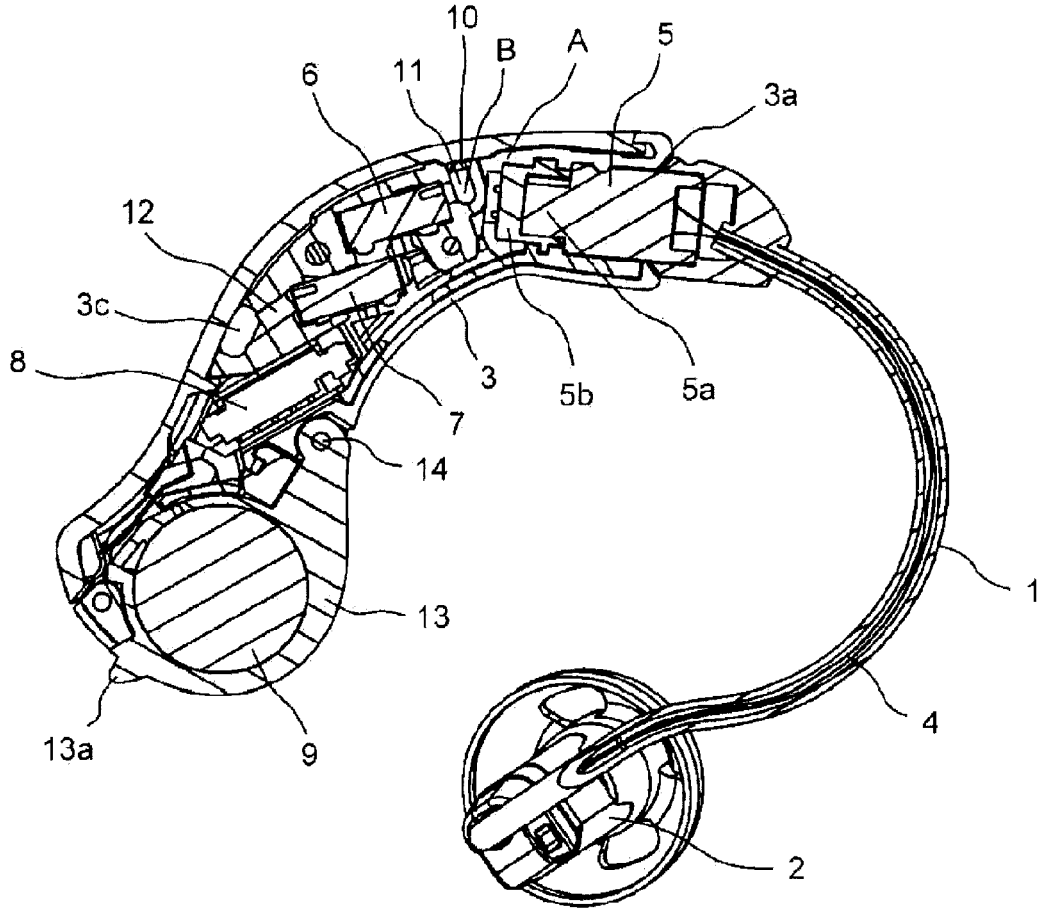
FIG. 3 is a front cross section of an embodiment of the present invention.
Figure 4:
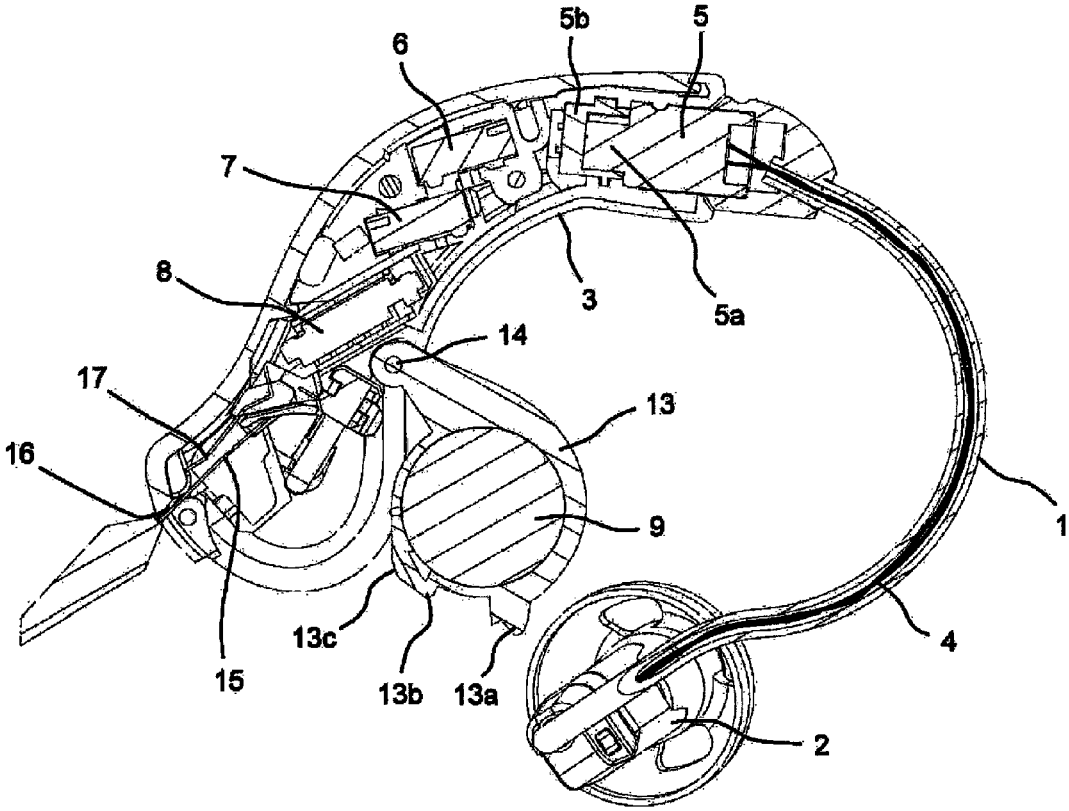
FIG. 4 is a front cross section of an embodiment of the present invention.

As shown in FIGS. 3 and 4, wiring 4 that electrically connects the earphone 2 and the main body case 3 are built into the ear hook 1. As shown in FIG. 3, an electrical connection means 5, a front microphone 6, a rear microphone 7, a control element 8, and a battery 9 are provided in that order inside the main body case 3. The rear end side of the front microphone 6 and the front end side of the rear microphone 7 overlap in the longer direction between the front and rear ends of the main body case 3 (that is, in the direction along the curving shape of the main body case 3) inside the main body case 3 as shown in FIG. 3.

The rear end side of the rear microphone 7 and the front end side of the control element 8 overlap in the longer direction between the front and rear ends of the main body case 3 inside the main body case 3 as shown in FIG. 3. In this way, the front microphone 6, the rear microphone 7 and the control element 8 overlap in the longer direction between the front and rear ends of the main body case 3 inside the main body case 3 as shown in FIG. 3. Consequently, the front microphone 6, the rear microphone 7, and the control element 8 are housed in a compact fashion inside the main body case 3, which has a curved shape as discussed above.

The electrical connection means 5 in this embodiment is constituted by a plug 5*a* linked to the rear end of the wiring 4, and a plug receptacle 5*b* that detachably joins the plug 5*a* both mechanically and electrically. The plug receptacle 5*b* is fixed and provided inside the main body case 3 as shown in FIG. 3. Accordingly, when the plug 5*a* and the plug receptacle 5*b* are joined, the plug 5*a* is inserted into the main body case 3 through a front end opening 3*a* of the main body case 3, so that the plug 5*a* is detachably joined to the plug receptacle 5*b* both mechanically and electrically.

The main body case 3 can be used on either the left or the right. To convert the hearing aid from the right ear use shown in FIG. 3 to left ear use, a left-ear earphone (not shown), ear hook 1, and plug 5*a* are mounted, and this left-ear plug 5*a* is detachably joined to the plug receptacle 5*b* mechanically and electrically. Naturally, in FIG. 3, the ear hook 1 may not be removed, and just the right earphone 2 removed and replaced with a left earphone (not shown).

Figure 1A:
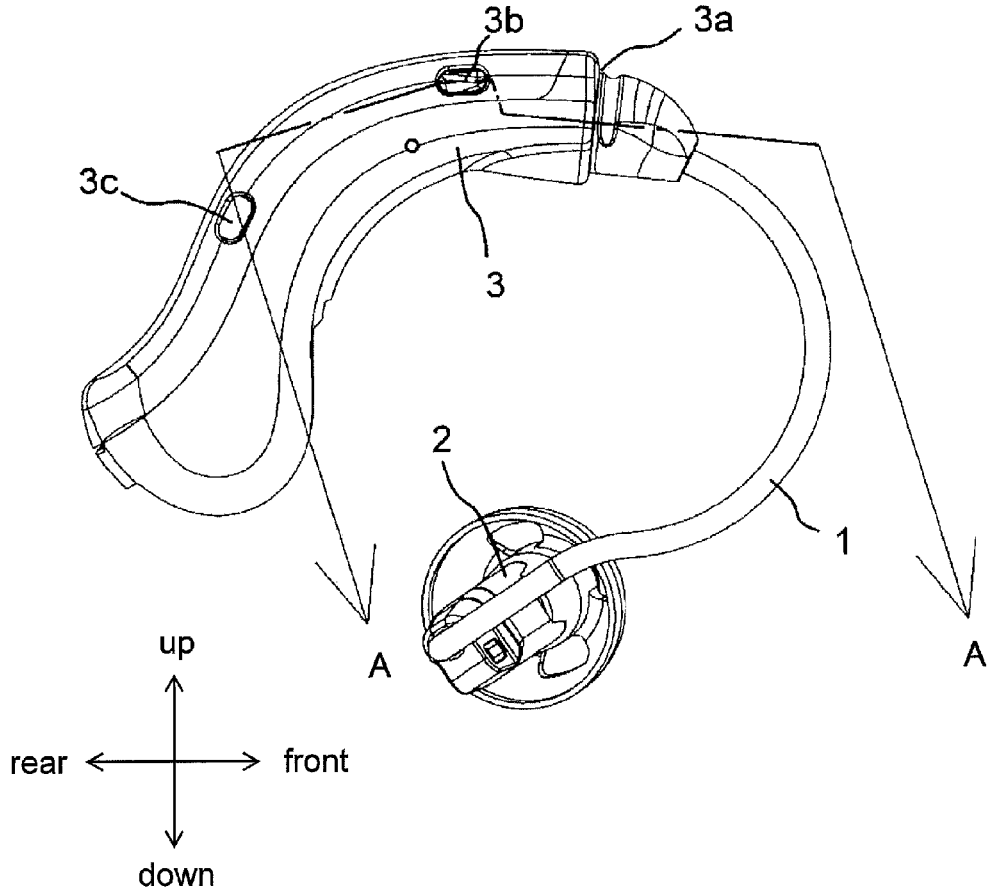
FIG. 1A is a front view of an embodiment of the present invention.
Figure 1B:
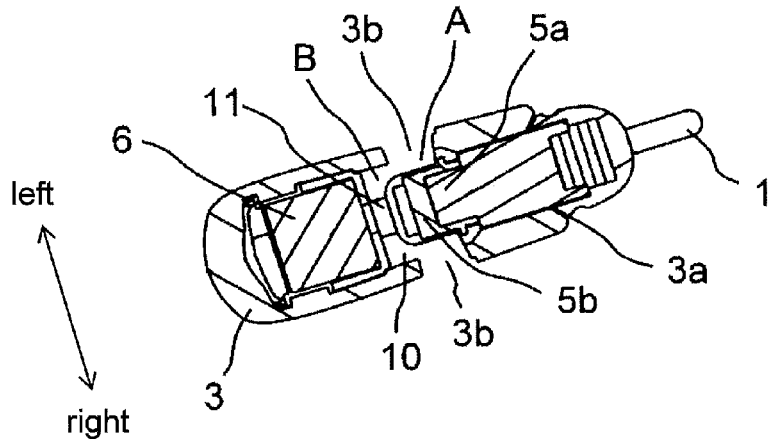
FIG. 1B is a cross section along the A-A line in FIG. 1A.
Figure 2A:
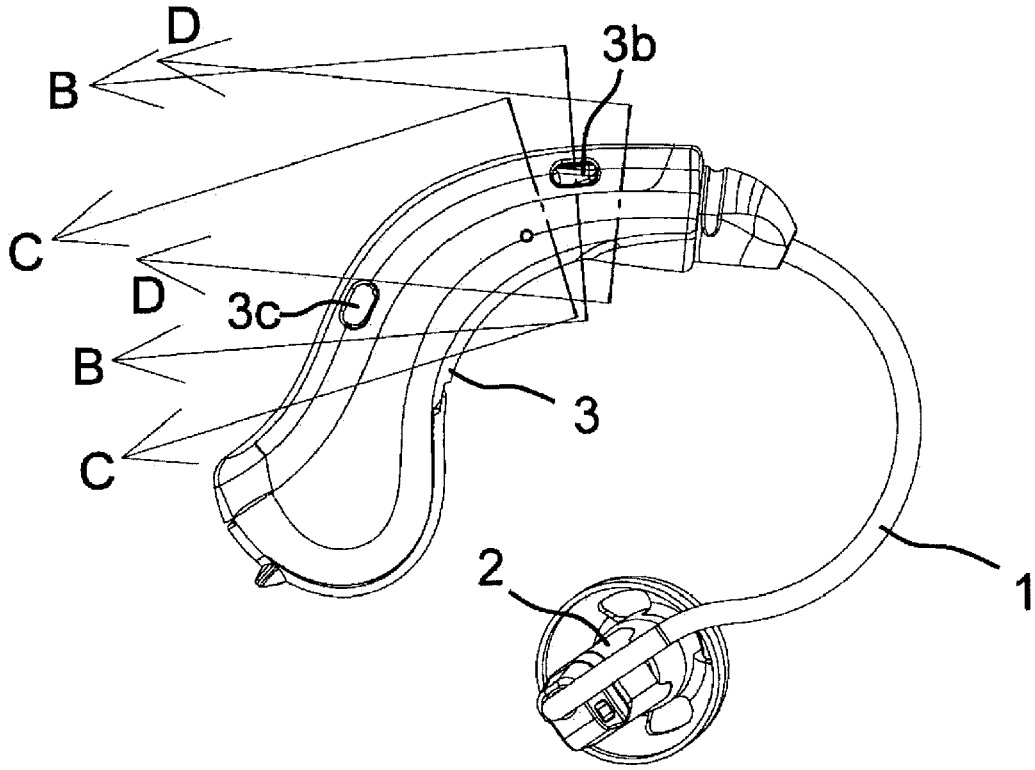
FIG. 2A is a front view of an embodiment of the present invention.
Figure 2B:
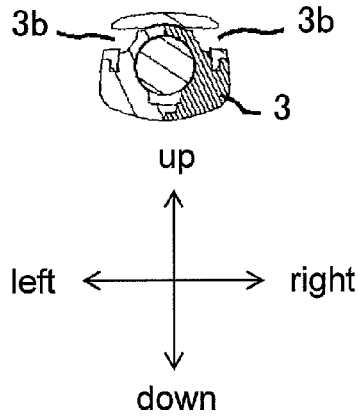
FIG. 2B is a cross section along the B-B line in FIG. 2A.
Figure 2C:
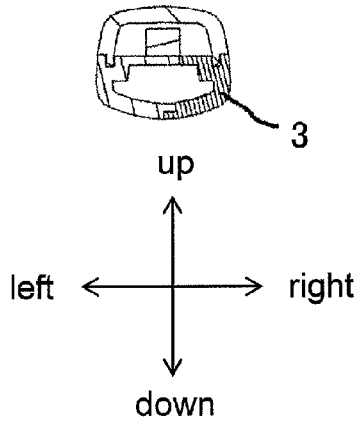
FIG. 2C is a cross section along the C-C line in FIG. 2A.
Figure 2D:
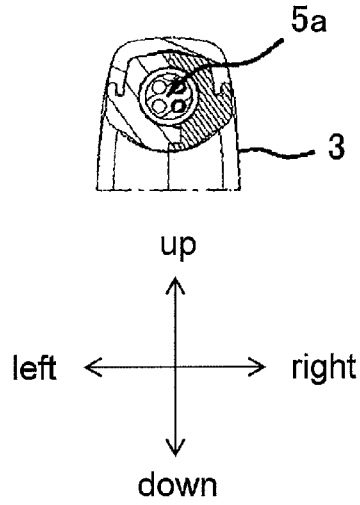
FIG. 2D is a cross section along the D-D line in FIG. 2A.

A front sound hole 3*b* is provided to the outer peripheral portion of the plug receptacle 5*b*, out of the outer wall face of the main body case 3 having this curved shape (see FIGS. 1A and 1B). The plug receptacle 5*b* constitutes the electrical connection means 5. Also, a rear sound hole 3*c* is provided to the outer peripheral portion of the control element 8, out of the outer wall face of the main body case 3. The rear sound hole 3*c* is provided at the rear of the front sound hole 3*b* (see FIG. 3).

The front sound hole 3*b* and the rear sound hole 3*c* are provided on both the left and right sides of the main body case 3, centering around the longer direction of the main body case 3, as can be seen in FIGS. 1A and 1B, FIGS. 2A to 2D and FIG. 3. This allows the hearing aid to be used on either the left or right side as mentioned above.

In this embodiment, as discussed above, the front sound hole 3*b* is provided to the outer peripheral portion of the plug receptacle 5*b*, out of the outer wall face of the main body case 3 having this curved shape. The plug receptacle 5*b* constitutes the electrical connection means 5. Let us describe this point in greater detail. A space A is provided, as shown in FIG. 3, between the inner wall face of the main body case 3 and the plug receptacle 5*b* constitutes the electrical connection means 5. The front sound hole 3*b* is provided to the portion that surrounds this space A, out of the outer wall face of the main body case 3.

Also, a space B is provided between the plug receptacle 5*b* and the front microphone 6, as can be seen from FIGS. 1B and 3.

The front sound hole 3*b* and the front microphone 6 are acoustically joined via a front sound conducting path 10 formed by these spaces A and B. A dust filter 11 is provided to the portion that is ahead of the front microphone 6 in the front sound conducting path 10. Therefore, any sound that enters the main body case 3 through the front sound hole 3*b* is transmitted to the front microphone 6 through the front sound conducting path 10 in which the dust filter 11 is provided, and is converted into an electrical signal by the front microphone 6.

Similarly, any sound that enters the main body case 3 through the rear sound hole 3*c* is transmitted to the rear microphone 7 through a rear sound conducting path (not shown) in which a dust filter 12 is provided, and is converted into an electrical signal by the rear microphone 7. The electrical signals outputted from the front microphone 6 and the rear microphone 7 are processed and amplified by the control element 8, and transmitted through the wiring 4 to the earphone 2, which provides a hearing aid action.

With the constitution of this embodiment, the distance between the front sound hole 3*b* and the rear sound hole 3*c* in the horizontal direction (more specifically, the front and back direction of the user) can be increased, so the time differential between sounds captured by the front sound hole 3*b* and the rear sound hole 3*c* can be increased. As a result, it is easier to tell whether the source of the sound is coming from front or back.

Also, since there is ample distance between the front sound hole 3*b* and the rear sound hole 3*c*, the size of the main body case 3 itself can be correspondingly reduced, and this makes the device more comfortable to wear.

A conventional example will now be described for the sake of comparison. With a conventional hearing aid, since the plug receptacle 5*b* is located in the main body case 3, the front sound hole 3*b* has to be provided to the portion that surrounds the space B, out of the outer walls of the main body case 3. Consequently, with a conventional hearing aid, the distance between the front sound hole 3*b* and the rear sound hole 3*c* in the horizontal direction (more specifically, the front and back direction of the user) was shorter than with the hearing aid pertaining to this embodiment shown in FIG. 1, by the length of the front sound hole 3*b*, for example. Accordingly, it was difficult to increase the time differential of the sounds captured by the front sound hole 3*b* and the rear sound hole 3*c*. As a result, it is hard for the user to tell if the sound is coming from the front or the back.

In contrast, in this embodiment, the distance between the front sound hole 3*b* and the rear sound hole 3*c* in the horizontal direction (the front and back direction of the user) can be increased by the length of the front sound hole 3*b*, for example, over that of a conventional hearing aid. This means the time differential of the sounds captured by the front sound hole 3*b* and the rear sound hole 3*c* can be increased, and as a result, it is easier for the user to tell if the sound is coming from the front or the back.

As mentioned above, the main body case 3 is provided along the rear of the ear, so it is small in the horizontal direction to start with. Accordingly, being able to increase the distance between the front sound hole 3*b* and the rear sound hole 3*c* in the horizontal direction (the front and back direction of the user) by the length of the front sound hole 3*b* as mentioned above means that the time differential of the sounds captured by the front sound hole 3*b* and the rear sound hole 3*c* can be made very large, and as a result, it is extremely easy for the user to tell if the sound is coming from the front or the back.

The above effect can be further enhanced by providing the front sound hole 3*b* to the portion that is closer to the front end than the outer peripheral portion of the plug receptacle 5*b*, out of the outer wall face of the main body case 3. Here, the space A may be provided between the inner wall face of the main body case 3 and the plug 5*a* shown in FIG. 1B.

Also, in this embodiment, as discussed above, the rear side of the front microphone 6 and the front side of the rear microphone 7 overlap in the longer direction between the front and rear ends of the main body case 3 inside the main body case 3 as shown in FIG. 3, and this allows a more compact size.

Let us describe this point in further detail. In this embodiment, the main body case 3 is shaped as shown in FIG. 3, so that it curves downward in a parabolic shape from the front end side toward the rear end side. Inside the downward curving portion of this main body case 3, the front microphone 6 and the rear microphone 7 are provided in an inclined state with their front ends higher than their rear ends. Also, portions of the front microphone 6 and the rear microphone 7 are provided in a state of overlapping in the up and down direction.

Inside the main body case 3 here, the front microphone 6 is provided above the rear microphone 7, and the rear end portion of the front microphone 6 and the front end portion of the rear microphone 7 overlap in the up and down direction. In this state, the front end portion of the front microphone 6 is acoustically connected to the front sound hole 3*b* via the front sound conducting path 10, and the rear end portion of the rear microphone 7 is acoustically connected to the rear sound hole 3*c* via a rear sound conducting path (not shown).

As above, with this embodiment, the front microphone 6 and the rear microphone 7 are provided inside the downward curving portion of the main body case 3, which has a shape that curves downward in a parabolic shape from the front end portion toward the rear end portion. The rear end sides of the front microphone 6 and the rear microphone 7 are provided above the respective rear end sides. Also, portions of the front microphone 6 and the rear microphone 7 are provided in a state of overlapping in the up and down direction.

In other words, the curved corners in the main body case 3 are inclined, and portions of the front microphone 6 and the rear microphone 7 are provided here in a state of overlapping in the up and down direction. Therefore, the front microphone 6 and the rear microphone 7 can be adequately provided without having to increase the size of the main body case 3. Accordingly, the main body case 3 can be made lighter, smaller, and less noticeable, which makes the hearing aid easier to use.

Also, the front microphone 6 here is provided above the rear microphone 7 inside the main body case 3. Consequently, the front portion of the front microphone 6 can be acoustically connected in a short distance to the front sound hole 3*b* via the front sound conducting path 10. Also, the rear portion of the rear microphone 7 can be acoustically connected in a short distance to the rear sound hole 3*c* via a rear sound conducting path (not shown). As a result, the front sound conducting path 10 and the rear sound conducting path (not shown) can be reduced in volume, and this allows the main body case 3 to be more compact.

Figure 5:
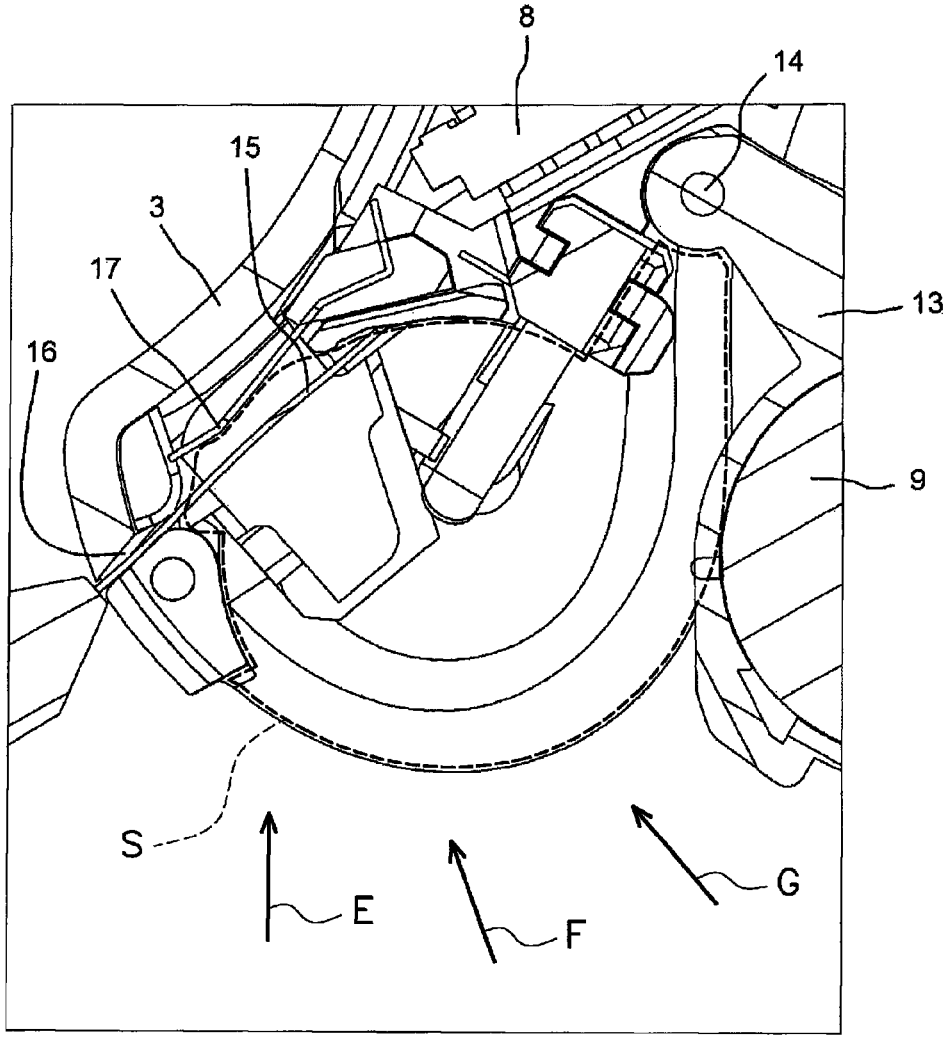
FIG. 5 is a detail front cross section of an embodiment of the present invention.
Figure 6:
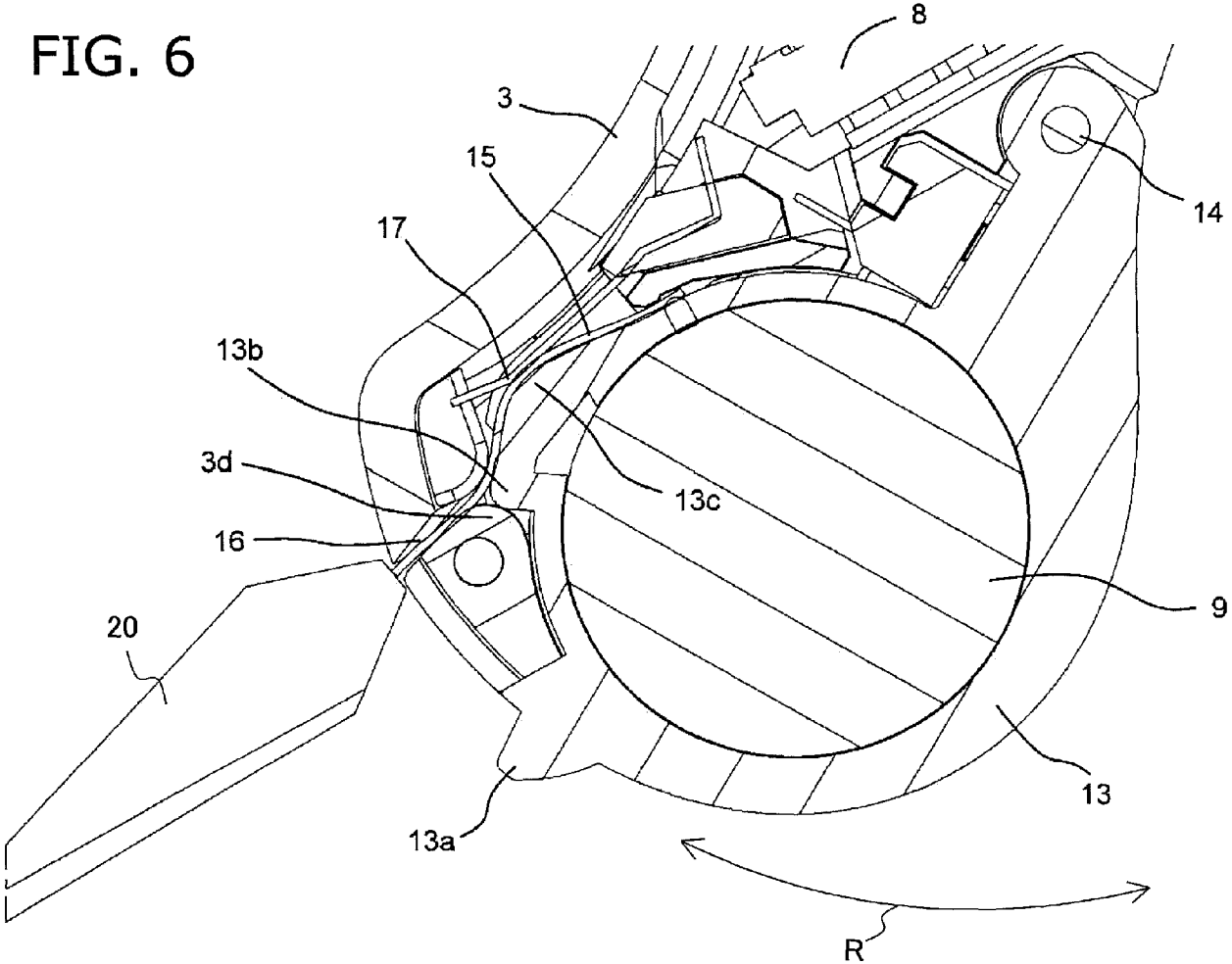
FIG. 6 is a detail front cross section of an embodiment of the present invention.

Also, with this embodiment, a battery 9 is housed as shown in FIGS. 4 to 6 inside the rear end portion of the main body case 3 as discussed above. This battery 9 is removably housed in a battery case 13 that can be installed or removed by turning, allowing the battery 9 to be replaced.

As shown in FIGS. 4 to 6, the rotational axis 14 of the battery case 13 is provided on the radial inner side inside the curved rear end portion of the main body case 3 (that is, to the ear when the hearing aid is worn). When the battery 9 is replaced, an open protrusion 13*a* (not shown in FIG. 1A; see FIG. 3) of the battery case 13 provided outside the main body case 3 in the state shown in FIG. 1A is turned with a finger to the right in FIG. 4 (that is, to the front when the hearing aid is worn). Thereupon, the battery case 13 turns around the rotational axis 14 as shown in FIG. 4, and the battery case 13 swings outside of the main body case 3. Accordingly, in this state the used battery 9 can be replaced with an unused battery 9.

The battery case 13 is then stowed in the main body case 3 by rotating the battery case 13 to the left in FIG. 4 (that is, to the rear when the hearing aid is worn). Thus, when the battery case 13 is stowed back inside the main body case 3, as shown in FIG. 6, a locking protrusion 13*b* (first locking protrusion) provided to the battery case 13 engages with a locking protrusion 3*d* (second locking protrusion) of the main body case 3. This allows the battery case 13 to be housed in a locked state inside the main body case 3.

As shown in FIGS. 4 to 6, an insertion opening 16 for inserting a fitting-use communication terminal 15 (second communication terminal) is provided on the radial outside inside the curved rear end portion of the main body case 3 (that is, the opposite side from the ear when the hearing aid is worn). More specifically, as shown in FIG. 6, the insertion opening 16 is provided to the rear of the locking protrusion 3*d* of the main body case 3 in the rotational direction R of the battery case 13. The term "fitting" here refers to using a hearing aid adjustment device 20 connected to the communication terminal 15 and adjusting the effect of the hearing aid for a specific user.

Also, a communication terminal 17 for performing fitting (first communication terminal) is provided on the radial outside inside the curved rear end portion of the main body case 3. More specifically, as shown in FIG. 6, the communication terminal 17 is provided at the back of the insertion opening 16 (that is, a location farther into the interior of the main body case 3 from the insertion opening 16).

During fitting, the above-mentioned battery case 13 is removed as shown in FIG. 4, and in this state the communication terminal 15 is inserted through the insertion opening 16 as shown in FIGS. 4 and 5. Since the battery case 13 is pulled out at this point, the insertion state of the communication terminal 15 and the relative positions of the communication terminals 15 and 17 can be visually checked, making the device easier to operate. More specifically, the user can, for example, check the insertion state of the communication terminal 15 from the directions of the arrows E, F, and G in FIG. 5.

In this embodiment, the following specific configuration is employed so that the insertion state of the communication terminal 15 and the relative positions of the communication terminals 15 and 17 can be visually checked during fitting. First, the battery case 13 is installed inside the rear end portion of the main body case 3, and is removable by turning. The rotational axis 14 of the battery case 13 is provided above the locking protrusion 13*b* of the battery case 13. The rotational axis 14 is provided on the radial inner side inside the curved main body case 3, and the locking protrusion 13*b* is provided on the radial outside inside the curved main body case 3.

Also, the locking protrusion 3*d* that engages with the locking protrusion 13*b* of the battery ease 13 is provided on the radial outside inside the curved rear end portion of the main body case 3. Furthermore, the insertion opening 16 for inserting the communication terminal 15 is provided further to the radial outside inside the curved rear end portion than the locking protrusion 3*d*. The communication terminal 17 is provided inside the insertion opening 16 (this is also on the radial outside inside the curved main body case 3). As shown in FIG. 6, a pressing protrusion 13*c* is provided on the rear side of the locking protrusion 13*b* in the rotational direction R of the battery case 13. Thus, the pressing protrusion 13*c* is formed corresponding to the communication terminal 17.

Therefore, during fitting, if the above-mentioned battery case 13 is opened as shown in FIG. 5, the communication terminal 17 can be visually checked from the outside of the main body case 3 (arrow directions E, F, and G, for example) in the space S in which the battery case 13 has moved (the space in which the battery case 13 is housed). When the communication terminal 15 is inserted as shown in FIG. 5 through the insertion opening 16 in this state, the joining state of the communication terminals 15 and 17 can also be visually checked, which means that the proper joining state of the communication terminals 15 and 17 can easily be accomplished. Accordingly, when the battery case 13 is moved from the state in FIGS. 4 and 5 and stowed in the main body case 3 as shown in FIG. 6, the pressing protrusion 13*c* of the battery case 13 presses the communication terminal 15 against the communication terminal 17, and this creates a good electrical connection between the communication terminals 15 and 17. If the control element 8 is driven in this state, fitting with the hearing aid adjustment device 20 can be performed in a simple manner. That is, with this embodiment, the proper joining state of the communication terminals 15 and 17 can be easily accomplished, so the work of fitting the hearing aid can be carried out smoothly.

INDUSTRIAL APPLICABILITY

As discussed above, when a battery case is turned and removed in order to perform fitting, a fitting-use first communication terminal is exposed in the space that houses the battery case 13, so that it can be visually checked from outside the main body case. Therefore, the joining state of this first communication terminal and a fitting-use second communication terminal inserted from outside the main body case can be checked visually. Therefore, when the battery case is subsequently turned back into the main body case, a pressing protrusion provided to the battery case will press the first and second communication terminals together. This affords a good electrical contact between the first and second communication terminals, so the fitting work can be carried out smoothly. Therefore, the hearing aid can be put to better use.

What is claimed is:

1. A hearing aid, comprising:

an ear hook bent for attachment to an ear;

an earphone linked to a front end side of the ear hook;

a main body case linked to a rear end side of the ear hook; and a battery case attached to the main body case, wherein the main body case is formed in a shape that curves downward in a parabolic shape from a front end portion toward a rear end portion, the battery case is installed inside the rear end portion of the main body case, and is removable by turning, the main body case has a fitting-use first communication terminal provided on the radial outside in the main body case, the first communication terminal is electrically connected to a fitting-use second communication terminal inserted from outside the main body case for fitting work, the first communication terminal and the second communication terminal can be visually checked from outside the main body case when the battery case is removed by turning, the battery case has a first locking protrusion that is engaged with the main body case when the battery case is turned for installation, and a pressing protrusion that is opposite the first communication terminal and presses the second communication terminal to the first communication terminal when the battery case is installed for the fitting work, and the turning axis of the battery case is provided on the radial inside in the main body case, and is located above the first locking protrusion of the battery case when the battery case is turned for installation.

2. The hearing aid according to claim 1, wherein the main body case has:

a second locking protrusion that is provided at the rear end portion of the main body case and is engaged to the first locking protrusion, and an insertion opening that is formed at the rear of the second locking protrusion in the turning direction of the battery case, for inserting the second communication terminal.

3. The hearing aid according to claim 2, wherein the first communication terminal is provided at the back of the insertion opening of the main body case.

4. The hearing aid according to claim 1, wherein the pressing protrusion is provided to the battery case at the rear of the first locking protrusion in the turning direction of the battery case.

* * * * *